US006868166B1

(12) United States Patent
Zhang et al.

(10) Patent No.: US 6,868,166 B1
(45) Date of Patent: Mar. 15, 2005

(54) CHORD-LIKE VIBRATION LOUDSPEAKER

(76) Inventors: Xiafu Zhang, Department of Basic Science, Kunming University of Science & Technology, Kunming, Yunnan, 650093 (CN); Xu Zhang, 286 East 54th Ave., Vancouver, British Columbia (CA), V5X 1K9; Lina Zhang, Department of Basic Science, Kunming University of Science & Technology, Kunming, Yunnan, 650093 (CN)

( * ) Notice: Subject to any disclaimer, the term of this patent is extended or adjusted under 35 U.S.C. 154(b) by 332 days.

(21) Appl. No.: 09/677,777

(22) Filed: Sep. 27, 2000

Related U.S. Application Data

(63) Continuation of application No. PCT/CN99/00011, filed on Jan. 28, 1999.

(30) Foreign Application Priority Data

Jun. 10, 1998 (CA) ..... 2236995

(51) Int. Cl.[7] ..... H04R 1/00
(52) U.S. Cl. ..... 381/399; 381/176
(58) Field of Search ..... 381/399, 176, 381/423, 431, 412, 419, 421, 424, 426, 427

(56) References Cited

U.S. PATENT DOCUMENTS

| | | | | | |
|---|---|---|---|---|---|
| 2,164,157 | A | * | 6/1939 | Kennedy | |
| 2,233,886 | A | * | 3/1941 | Cowley et al. | |
| 3,564,163 | A | * | 2/1971 | Hobrough | 381/399 |
| 3,636,278 | A | * | 1/1972 | Heil | 381/163 |
| 4,027,111 | A | * | 5/1977 | Kasatkin et al. | |
| 5,325,439 | A | * | 6/1994 | Smiley | 381/399 |
| 6,434,252 | B1 | * | 8/2002 | Royer et al. | 381/399 |

* cited by examiner

*Primary Examiner*—Sinh Tran
*Assistant Examiner*—Brian Ensey

(57) ABSTRACT

This invention is a loudspeaker that consists of some vibratory membranes and magnets. Every vibratory membrane is a part of a soft conductive tape and is put in a magnetic field. When the membranes conduct audio current, they vibrate air directly with their surfaces, and produce sound waves. This loudspeaker can be made into various shapes. It has overcome the defect of sound distortion caused by the diaphragm deformations in regular loudspeakers. Its distortion is lower, its transient response is excellent, and its voice quality and acoustic effects are admirable.

10 Claims, 1 Drawing Sheet

CHORD-LIKE VIBRATION LOUDSPEAKER

This application is a continuation of PCT/CN99/00011, filed Jan. 28, 1999.

TECHNICAL FIELD

This invention relates to a chord-like vibrating electrical loudspeaker, in which the vibratory membranes are some parts of a thin and soft conductive tape, or some coils. The vibration of the membrane is similar to the vibration of a chord. This kind of vibration is derived from the mechanical elastic strain.

BACKGROUND OF THE INVENTION

It is common that a regular electrical loudspeaker is composed of two distinct parts: the voice coil and the diaphragm. Although a diaphragm can be made into various styles, such as cone, spherical cap and plate, it is always driven by a voice coil. The vibration of the voice coil and the diaphragm is similar to the vibration of a piston. The vibration manner causes unavoidable deformities to the diaphragm when it vibrates. Therefore, it is difficult to eliminate the sound distortion.

The purpose of this invention is to advance a new kind of loudspeaker that overcomes technological defects of present electrical loudspeakers. It has good sound, and possesses the whole range of audio frequencies with lower distortion.

SUMMARY OF THE INVENTION

This new kind of loudspeaker is composed of some vibratory membranes and magnets. *% field. When the vibratory membrane conducts audio current, a dynamic magnetic field is produced. The interaction between the dynamic magnetic field and the static magnetic field of the magnets causes the vibration of the membrane. The vibratory membranes push air directly with their surfaces, and produce sound waves. The vibration of the membrane is similar to the vibration of a chord.

DETAILED DESCRIPTION

Figure 1:
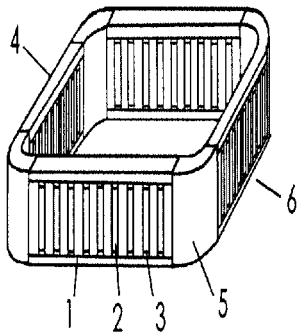
FIG. 1 represents a magnetic body composed of rectangular bar magnets with closed magnetic circuit.
Figure 2:
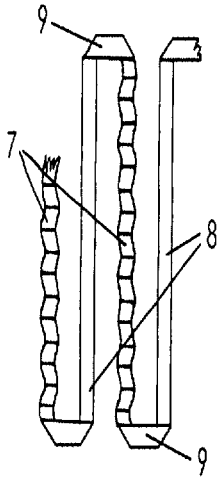
FIG. 2 shows a section of the conductive tape.
Figure 3:
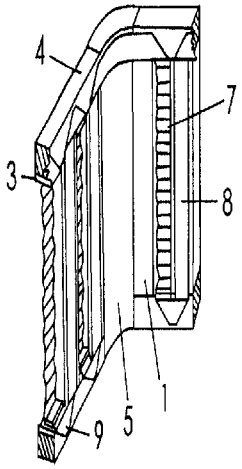
FIG. 3 shows the configuration after the vibratory membranes are installed on the body of rectangular bar magnets. There only three vibratory membranes are shown in the figure.

The specific scheme is as follows: We use some magnets to construct the magnetic body of the loudspeaker, in which a space is preserved between every two adjacent magnets. The space is referred to as a magnetic gap. The configuration of the magnetic body can be a hollow square column, a loop tube, or some other shapes. It depends on the shape and physical arrangement of the magnets. We can choose one from many shapes of magnets, such as a rectangular bar, ring, or other shapes. Obviously, the form of the magnetic gap depends on the shape of the magnets. It would be better if the width of the magnetic gap is less than the thickness of the magnet. The magnetic fields in these gaps are very strong. On the other hand, we put some parts of a soft conductive tape in a shaper and heat them respectively, such that these parts appear as stable wavy folds. After that they can be free to expand and contract like a spring. We call them vibratory membranes. The length of the membrane and the distance between two membranes depend on the shape and the size of the magnets. The width of the membrane should be a little less than the width of the magnetic gap. We subsequently put these membranes into the magnetic gaps, and fix them with corresponding methods. For example, for a strip gap (shown as FIG. 1), the two ends of every vibratory membrane are respectively fixed on the top and the bottom of the gap, the middle part of the membrane is suspended, the intervals between the edges of the membrane and the magnets are filled with ferrofluid. For a loop gap (shown as FIG. 4), every vibratory membrane is configured into a loop and is laid in a loop gap; both sides of the membrane are immersed in the ferrofluid, which is attracted to surfaces of the magnets.

Compared with present technology, this invention has the following advantages: Various forms of sound radiation can be used to improve the sound quality because this loudspeaker can be made into various shapes. Some detrimental vibrations that occur in regular loudspeakers do not happen in this new loudspeaker, because the vibration manner of the membranes of this loudspeaker is different from the vibration manner of a piston. In particular, the conductive membranes of the loudspeaker are immersed in magnetic fields completely. When the audio current goes through the membranes, free oscillations of the membranes are always prevented by the electromagnetic induction; therefore, the sound distortion of this loudspeaker is lower than that of regular loudspeakers. This new loudspeaker can produce sound in the whole range of audio frequencies. Its transient response is very good because the vibratory membranes are light, thin and soft. This loudspeaker does not interfere with electric devices around it because the magnetic body adopts closed magnetic circuit. With a suitable cover box, we can effectively utilize internal sound waves to raise bass.

Embodiment Example 2

Figure 4:
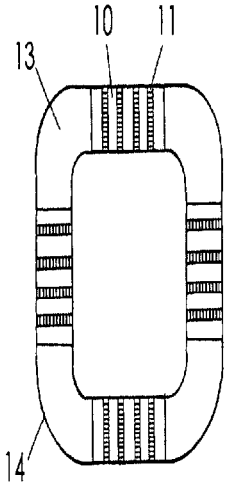
FIG. 4 is a plan view of a magnetic body of ring magnets with closed magnetic circuit.
Figure 5:
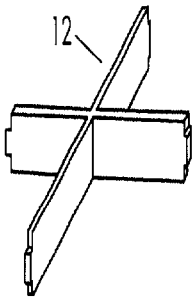
FIG. 5 shows a supporter that is located in a magnetic gap of the ring magnets.
Figure 6:
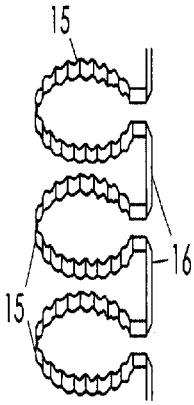
FIG. 6 shows the configuration of the vibratory membranes to be installed in the body of ring magnets.
Figure 7:
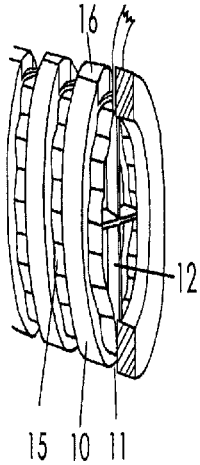
FIG. 7 shows the positions of the vibratory membranes in the body of ring magnets. There only three vibratory membranes are shown in the figure.

As shown in FIG. 4, FIG. 5, FIG. 6, and FIG. 7, there is a loop magnetic gap 11 between every two adjacent ring magnets 10; a supporter 12 is placed in each loop magnetic gap 11. FIG. 4 shows that five ring magnets 10 and four supporters 12 are combined into a cylinder, then four cylinders and four bent iron tubes 13 are combined into the closed magnetic body 14, which forms a loop tube. The loop vibratory membranes 15 are placed in the loop magnetic gaps 11, and the intervals between both edges of each membrane and the surfaces of the magnets are filled with ferrofluid. The flat parts 16 of the tape are stuck on the surfaces of the magnets and the tube. When audio current goes through the tape, the membranes 15 will vibrate in a chord-like manner and produce sound waves.

In the examples, every loop vibratory membrane can be also replaced by a loop coil. First we wind an insulated wire with minor diameter on a cylinder in a single layer. The width of the layer would be a little less than the width of the loop magnetic gap. Then we apply glue on the surface of the layer and remove the cylinder. In consequence, a thin and tape-like loop coil is made. The diameter of the loop coil corresponds to that of the loop gap. Each part of the loop coil is shaped into wavy folds, which resemble 15 in FIG. 6 except that the loop is closed. Each coil is entirely laid in a gap. The interval between the edges of the coils and the magnets are filled with ferrofluid. All the coils can be connected in parallel or series. Particularly, we can obtain a high impedance loudspeaker by connecting the coils in series.

The embodiments of the invention in which an exclusive property or privilege is claimed are defined as follows:

1. A chord-like vibrating loudspeaker comprises vibratory membranes and permanent magnet units, each magnet unit is fixed around a common symmetric axis with arch irons; a magnetic gap is formed between every two adjacent permanent magnets of the magnet units; each pair of adjacent planes are the planes of opposite poles of said permanent magnets; each vibratory membrane is put in each said magnetic gap; the number of said vibratory membranes and said magnet units are more than two.

2. A chord-like vibrating loudspeaker as defined in claim 1, in which said arch irons are placed in between the magnet units with a tight fit; the sections of the irons perpendicular to their magnetic inductive lines are the same or larger than the planes of the poles of the magnets.

3. A chord-like vibrating loudspeaker as defined in claim 1, in which each said magnetic gap is a space formed between said every two adjacent permanent magnets; the boundaries of the space are parallel planes of the pair of opposite poles of the permanent magnets.

4. A chord-like vibrating loudspeaker as defined in claim 1, in which said vibratory membrane is a part of a soft and elastic tape made from metallic conductor and plastic.

5. A chord-like vibrating loudspeaker as defined in claim 1, in which the width of said vibratory membranes is the same or less than the width of said magnetic gaps; and the surfaces of said vibratory membranes are perpendicular to the planes of the magnetic poles.

6. A chord-like vibrating loudspeaker as defined in claim 1, in which said vibratory membranes are shaped into wavy folds; on the folds, only the lines perpendicular to the edges of said vibratory membranes and the planes of the poles are straight lines.

7. A chord-like vibrating loudspeaker as defined in claim 1, in which each said vibratory membrane is made of a thin single-layer coil.

8. A chord-like vibrating loudspeaker as defined in claim 1, in which said permanent magnets are rectangular bars; each said magnetic gap is a rectangular space; both ends of said vibratory membrane are fixed on supporters at both ends of said magnetic gap respectively, the middle part of said vibratory membrane is suspended in said magnetic gap.

9. A chord-like vibrating loudspeaker as defined in claim 1, in which said permanent magnets are magnetic rings; each said magnetic gap is a loop space, where said vibratory membrane is placed.

10. A chord-like vibrating loudspeaker as defined in claim 1, in which the intervals between the edges of said vibratory membranes and the planes of the magnetic poles are filled with Ferro fluid.

* * * * *